United States Patent [19]

Kawaguchi et al.

[11] Patent Number: 4,749,618

[45] Date of Patent: Jun. 7, 1988

[54] TIP MEMBER FOR COATING TOOL

[75] Inventors: Keizo Kawaguchi; Kiyoshi Kuroyanagi, both of Aichi; Gengo Shinada, Osaka; Yasutaka Shinguu, Hyogo, all of Japan

[73] Assignees: Pilot Ink Co., Ltd.; Kabushiki Kaisha Fujiko, both of Japan

[21] Appl. No.: 838,732

[22] Filed: Mar. 11, 1986

[30] Foreign Application Priority Data

Mar. 11, 1985 [JP] Japan ..... 60-34274[U]
Apr. 10, 1985 [JP] Japan ..... 60-53468[U]

[51] Int. Cl.[4] ..... B43K 5/00; D02G 3/00

[52] U.S. Cl. ..... 428/375; 401/196; 401/198; 401/199; 428/397; 428/398; 428/399; 428/400

[58] Field of Search ..... 428/375, 358, 122, 397, 428/399, 400; 401/196, 198, 199

[56] References Cited

U.S. PATENT DOCUMENTS

| | | | |
|---|---|---|---|
| 2,666,976 | 1/1954 | Olmer et al. | 428/399 |
| 3,715,254 | 2/1973 | Tolgyesi | 428/364 X |
| 4,086,312 | 4/1978 | Midorikawa | 401/198 X |
| 4,104,781 | 8/1978 | Midorikawa | 401/196 X |
| 4,119,756 | 10/1978 | Midorikawa | 401/198 X |
| 4,287,146 | 9/1981 | Midorikawa | 401/198 X |
| 4,381,325 | 4/1983 | Masuda et al. | 428/399 X |
| 4,496,258 | 1/1985 | Tanaka et al. | 401/198 X |
| 4,568,214 | 2/1986 | Abe et al. | 401/196 X |

*Primary Examiner*—Lorraine T. Kendell
*Attorney, Agent, or Firm*—Sughrue, Mion, Zinn, Macpeak, and Seas

[57] ABSTRACT

A tip member for a coating tool in the form of a stick, wherein the stick is formed of a bundle of resin-treated fibers substantially uniformly stretched in the longitudinal direction of the fibers. One end of the stick is tapered to the tip with the fibers being unraveled to unbind the fibers in that area. One or more longitudinal grooves may be formed in the surface of the stick.

4 Claims, 1 Drawing Sheet

TIP MEMBER FOR COATING TOOL

BACKGROUND OF THE INVENTION

The present invention relates to a tip member for a coating tool, and more particularly to such a tip member fixed to the tip of a cylindrical body for use in storing a small quantity of viscous liquid, including cosmetic, marking and paper correction liquids, paint, adhesives for use in assembling plastic models, etc.

There have heretofore been proposed various tip members for coating tools of the type aforementioned. To prepare such tip members, a method is employed including steps of coating the exterior of a bundle of fibers with a plastic material and sharpening both opposite sides of the tip member toward the axis thereof to provide a writing tool with suitable inclines (see Japanese Examined Utility Model Appln. No. 59-39943 Published Nov. 10, 1984), or attaching a tapered hollow porous communicating body to a liquid inducing core to provide a double structure (see Japanese Laid-Open Utility Model Appln. No. 59-141907 published Sept. 21, 1984).

The tip members for those coating tools are required to function in such a manner as to temporarily hold the liquid sent out of the cylindrical body, supply a suitable quantity of liquid to the tip, and accordingly make smooth coating operations possible. The method proposed by Japanese Laid-Open Utility Model Appln. No. 59-141907 has satisfied those requirements by combining the above-described two members. However, the coating tools thus constructed are unavoidably expensive. In the case of the tip member proposed by Japanese Utility Model No. 59-39943, fibers tend to be deplumed if the fibrous density of the bundle of fibers is low, while the liquid will be insufficiently transferred if the fibrous density is high.

The present invention is intended to remedy such shortcomings, and it is therefore an object of the invention to provide an easy-to-manufacture tip member for a coating tool capable of solving all the above-mentioned problems inherent in conventional tip members and which allows fibers to hold large-sized grains of pigments during the intermittent use of the tip members over long periods of time, the coating liquid contains pigments of large-sized grains such as those of iron oxide, titanium oxide, aluminum, copper, copper alloy and mica dispersed therein, and to cause liquid with a reduced color tone, density or opacifying strength because of the filter effect to flow out.

SUMMARY OF THE INVENTION

The tip member for a coating tool in the form of a stick according to the present invention is prepared from a resin-treated bundle of fibers substantially uniformly stretched in their longitudinal direction, one end of the stick or a part thereof being tapered to the tip with fibers unraveled to unbind the fibers thereat. The stick is provided with at least one axially directed thin groove communicating with the tip member in the surface thereof.

DESCRIPTION OF THE PREFERRED EMBODIMENTS

Figure 1:
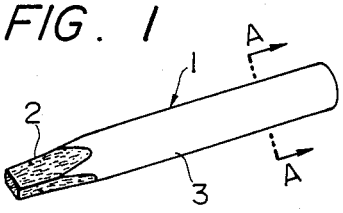
FIGS. 1 through 4 are perspective views of respective tip members embodying the present invention.
Figure 5:
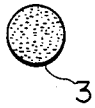
FIGS. 5, 6, 7, 8 and 9 are sectional views taken on lines A—A, B—B, C—C, D—D and E—E, respectively, in FIG. 1.

Referring now to the accompanying drawings, the present invention will be described with reference to preferred embodiments thereof.

A tip member 1 is a resin-treated porous body prepared from a bundle of fibers such as filaments and spun yarn substantially uniformly stretched in their longitudinal direction. Either continuous, long, parallel fibers or fiber slivers may be used. The stick-like porous body, which performs a capillary action, should be strong enough to withstand expected coating pressures. The porosity of the tip member 1 ranges from 20 to 90%, preferably, within the range of 35 to 85%. A base 3 functions so as to introduce liquid from a liquid storage section by means of capillary action and also to store the liquid temporarily to allow a suitable quantity of the liquid to be ready to flow out of the tip 2 at all times. One end of the tip 2 of the stick is tapered (FIGS. 1 through 4), and must be unraveled in order to unbind the fibers thereat. In this embodiment, moreover, a thin groove 4 communicating with the tip 2 is provided in the surface of the stick. The thin groove 4 is used to directly and quickly supplement the transfer of the liquid through the capillary gap and lead out the particles of pigments blocking the passages among the fibers by moistening them. The groove 4 should have a width and depth in a range from 0.3 to 3 mm, but is not limited to that range in consideration of the outer diameter of the tip member 1 and the properties of the coating liquid.

Examples of the present invention will subsequently be described.

EXAMPLE 1

Figure 2:
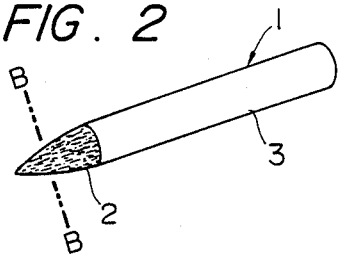
Figure 6:
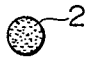

A continuous stick (porosity of 73%) 3 mm $\phi$ in outer diameter prepared from slivers of 7-denier acrylic fibers treated with melamine resin was cut into pieces 35 mm long and the cut pieces were tapered as shown in FIGS. 1 or 2. A presser tool was repeatedly pressed against the tapered faces to unbind the fibers and obtain desired coating tip members 1 with a tip 2 maintaining a given form.

EXAMPLE 2

Figure 3:
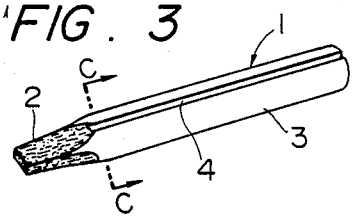
Figure 7:
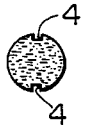
Figure 4:
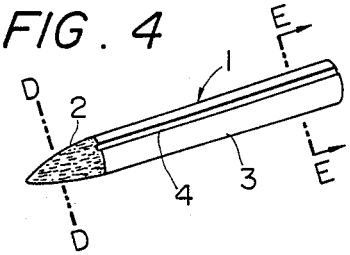
Figure 8:
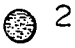
Figure 9:
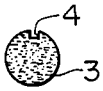

Recessed thin grooves 1.0 mm wide and 1.0 mm deep were respectively provided in side faces opposite to each other of a continuous stick (porosity of 73%, 5 mm $\phi$ in outer diameter) prepared from slivers of 7-denier acrylic fibers treated with melamine resin, and the stick was cut into pieces 35 mm long. The cut pieces were then tapered as shown in FIGS. 3 or 4. The presser tool was repeatedly pressed against the tapered faces to unbind the fibers and obtain desired coating tip members 1 with a tip 2 maintaining a given form.

The base 3 is a porous body having a given shape, a given strength, and a number of pores among the fibers bound by the treatment of the bundle of fibers with resin. The base 3 is capable of introducing a large quantity of the liquid stored in the liquid storage section quickly and stably by means of capillary action. Moreover, it can be readily processed so that it may fitted into a cylinder, and it is also satisfactorily durable. The tip 2 is tapered with a diameter gradually decreasing in the direction of the tip. It is generally characterized in that the fibers are unbound. Consequently, the following functions and effects are attained:

The tip 2 is provided with suitable softness, rigidity and elastic recovery properties, so that it is effective in coating thin lines and small or boundary surfaces. When relatively wide surfaces other than those described above are coated, the contact width can be changed to a suitable value by increasing the coating pressure, but the contact width will be restored to what it was when the pressure is released, whereby practical requirements for the repetitive use of such a coating tool are satisfied. The coating liquid is caused to flow out suitably in both cases.

In addition to the above-described effects, the coating tip member 1 of Example 2 provided with the thin grooves 4 in the axial direction of the surface of the stick is not affected by fine capillary gaps among the internal fibers, but allows a concentrated quantity of liquid to be introduced to the tip and contributes to sending out a suitable abundant quantity of coating liquid at all times. Particularly, when a coating liquid with dispersed pigments having a high specific gravity or large particles size is employed, the coating tool according to the present invention prevents troubles caused by blocked gaps among fibers or reduction in the concentration of coating liquid because of the filter effect resulting from the intermittent repetitive reuse of such a coating tool for a long period of time.

Figure 10:
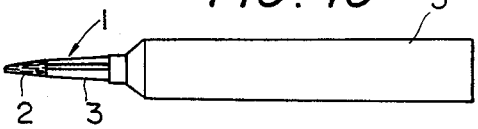
FIGS. 10 and 11 are elevational views of coating tools with a member embodying the present invention.
Figure 11:
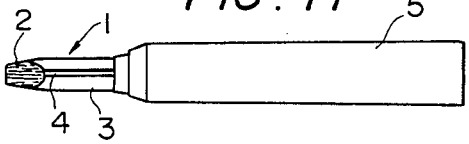

When the tip member 1 described in the examples above was attached to a cylindrical container 5 (FIGS. 10 or 11) filled with manicure liquid or ink with metal powder dispersed therein for actual use, it proved capable of sending out the liquid to the boundary between the nail and finger with suitable bodied rigidity and elasticity, or a proper quantity of ink to an intended surface with a satisfactory finish quality. The efficiency was also maintained even when the coating tool was reused intermittently and repetitively for a long time.

Those effects are attributed to proper rigidity and elasticity recovery properties due to the fact that resin is allowed to remain on the surfaces of the fibers and is bound thereto, even though the fibers in the tip section 2 have been unbound, whereby capillary gaps among the fibers in the tip section 2 are kept effective even when the tip is deformed. Even if the pigments block passages among fibers, the coating liquid is led through the thin groove 4 in the axial direction of the surface and allowed to flow out, so that the reduced-viscosity liquid in a stagnant condition is moistened and caused to flow.

In the member 1 according to the present invention, the base 3, whose fibers are found in the form of a stick, the tip 2, whose fibers have been unraveled, and the thin groove 4 cooperate to function effectively. Accordingly, problems derived from not only troublesome assembly work and high production costs due to the conventional composite body consisting of two members, but also dropping of fibers and fragility, as in the case of the conventional coating tool wherein only fibrous material is exposed from a covered body, are solved with the use of the invention. Moreover, a suitable quantity of coating liquid is allowed to flow, even if the coating tool is intermittently repetitively reused over long periods, thus making it possible to satisfy practical requirements for a coating tip member for a convenient coating tool.

We claim:

1. In a tip member for a coating tool in the form of a stick for coating a liquid, the improvement wherein said stick is formed of a resin-treated bundle of fibers substantially uniformly stretched in their longitudinal direction, said tip member having a porosity in the range of 20% to 90%, one end of said tip member being tapered to form a tip portion, and wherein said fibers of said tip portion are unraveled to unbind said fibers at said tip portion, and wherein said stick is provided with at least one axially directed thin groove communicating with said tip member at the surface thereof to cause a concentrated quantity of liquid to be introduced to said tip member and contribute to sending out a suitable abundant quantity of coating liquid at all times.

2. The tip member for a coating tool as claimed in claim 1, wherein said tip member has a porosity in a range of 35 to 80%.

3. The tip member for a coating tool as claimed in claim 1, wherein said fibers are selected from the group consisting of filaments, spun yarn, continuous, long parallel fibers, and fiber slivers.

4. The tip member for a coating tool as claimed in claim 1, wherein a width and depth of said at least one groove are in a range of 0.3 to 3 mm.

* * * * *